US011696080B2

(12) United States Patent
Ji et al.

(10) Patent No.: US 11,696,080 B2
(45) Date of Patent: Jul. 4, 2023

(54) BONE CONDUCTION HEARING AID DEVICE

(71) Applicant: Sonitus Medical (Shanghai) Co., Ltd., Shanghai (CN)

(72) Inventors: Yang Ji, Shanghai (CN); Qiangling Pu, Shanghai (CN)

(73) Assignee: Sonitus Medical (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/275,174

(22) PCT Filed: Jun. 12, 2020

(86) PCT No.: PCT/CN2020/095766
§ 371 (c)(1),
(2) Date: Mar. 10, 2021

(87) PCT Pub. No.: WO2021/248437
PCT Pub. Date: Dec. 16, 2021

(65) Prior Publication Data

US 2023/0090241 A1 Mar. 23, 2023

(51) Int. Cl.

| | |
|---|---|
| ***H04R 25/00*** | (2006.01) |
| ***H04R 1/28*** | (2006.01) |
| ***H04R 17/00*** | (2006.01) |

(52) U.S. Cl.
CPC ..... *H04R 25/606* (2013.01); *H04R 1/288* (2013.01); *H04R 17/00* (2013.01); *H04R 25/65* (2013.01); *H04R 2460/13* (2013.01)

(58) Field of Classification Search
CPC ..... H04R 1/028; H04R 2420/07; H04R 2460/13; H04R 25/606; H04R 1/46
See application file for complete search history.

(56) References Cited

U.S. PATENT DOCUMENTS

| | | | |
|---|---|---|---|
| 5,447,489 | A | 9/1995 | Issalene et al. |
| 2010/0098270 | A1 | 4/2010 | Abolfathi et al. |

(Continued)

FOREIGN PATENT DOCUMENTS

| | | | |
|---|---|---|---|
| CN | 101491115 | A | 7/2009 |
| CN | 201708923 | U | 1/2011 |

(Continued)

OTHER PUBLICATIONS

Notice of Reasons for Refusal dated Sep. 27, 2022 for Japanese Patent Application No. 2021-504537 and English Translation.

(Continued)

*Primary Examiner* — Amir H Etesam
(74) *Attorney, Agent, or Firm* — Ling Wu; Stephen Yang; Ling and Yang Intellectual Property

(57) ABSTRACT

Provided is a bone conduction hearing aid device, including: a housing, a piezoelectric vibration assembly and a vibration transmission element, the piezoelectric vibration assembly and the vibration transmission element are both arranged in the housing, a first end of the vibration transmission element is connected with the piezoelectric vibration assembly, a second end of the vibration transmission element is connected with the housing, and the housing includes a vibration output portion that outputs vibration through contact.

15 Claims, 8 Drawing Sheets

(56) References Cited

U.S. PATENT DOCUMENTS

| | | | | |
|---|---|---|---|---|
| 2011/0081031 | A1* | 4/2011 | Abolfathi ..... | H04R 17/005 381/151 |
| 2013/0236043 | A1 | 9/2013 | Abolfathi et al. | |
| 2014/0169592 | A1 | 6/2014 | Menzel et al. | |
| 2017/0318399 | A1 | 11/2017 | Meskens | |
| 2018/0242063 | A1 | 8/2018 | Chiang et al. | |

FOREIGN PATENT DOCUMENTS

| | | | |
|---|---|---|---|
| CN | 103026730 | A | 4/2013 |
| CN | 204145750 | U | 2/2015 |
| CN | 208675541 | U | 3/2019 |
| JP | 2012-515574 | A | 7/2012 |
| JP | 2013-531932 | A | 8/2013 |
| JP | 2019-536387 | A | 12/2019 |
| KR | 2002-0038197 | A | 5/2002 |
| WO | 2007140367 | A2 | 12/2007 |
| WO | 2018057347 | A1 | 3/2018 |
| WO | 2020084420 | A1 | 4/2020 |

OTHER PUBLICATIONS

Office Action dated Feb. 2, 2021 for Chinese Patent Application No. 202010535304.3 and English Translation.

Extended European Search Report dated Sep. 8, 2021 for European Patent Application No. 20824067.1.

Examination report dated Sep. 10, 2021 for Australian Patent Application No. 2020309092.

Ross J. Miller, "It's time we listened to our teeth: The SoundBite hearing system", American Journal of Orthodontics and Dentofacial Orthopedics, vol. 138, No. 5, Nov. 2010, pp. 666-669, XP027443279.

International Search Report for PCT/CN2020/095766 dated Feb. 20, 2021.

* cited by examiner

BONE CONDUCTION HEARING AID DEVICE

TECHNICAL FIELD

This application relates to, but is not limited to, the field of hearing aid equipment, in particular to a bone conduction hearing aid device.

BACKGROUND

At present, existing bone conduction hearing aid devices on the market are all bone-anchored hearing aid devices. The working principle thereof is to convert sound into vibration and then transmit the vibration to cochlea through skull to achieve a purpose of hearing improvement. Bone conduction hearing aid devices are usually implanted into bones by titanium screw threads. Thus, the installation of a hearing aid requires surgical implantation, which results in an inconvenience in the installation of the hearing aid.

SUMMARY

The following is a summary of the subject matter described in detail herein. This summary is not intended to limit the protection scope of the claims.

The present application provides a bone conduction hearing aid device, including: a housing, a piezoelectric vibration assembly and a vibration transmission element, wherein the piezoelectric vibration assembly and the vibration transmission element are both arranged in the housing, a first end of the vibration transmission element is connected with the piezoelectric vibration assembly, a second end of the vibration transmission element is connected with the housing, and the housing includes a vibration output portion that outputs vibration through contact.

Other aspects will become apparent upon reading and understanding the brief description of the drawings and the implementations of the embodiments of the present application.

REFERENCE SIGNS

100: bone conduction hearing aid device; 1: housing; 11: bottom housing; 12: top cover; 13: protruding portion; 14: fixation groove; 15: wire passing hole; 16: bottom wall; 17: top wall; 2: piezoelectric vibrator; 21: wire; 3: counterweight; 31: support surface; 32: support portion; 33: escape groove; 34: protrusion; 4: elastic damping member; 5: vibration transmission element; 51: arc-shaped mating surface; 52: installation groove; 6: adhesive; 200: fixation member; 300: electric control component; 400: tooth.

DETAILED DESCRIPTION

Embodiments of the present application will be described below in detail with reference to the accompanying drawings. It should be noted that the embodiments in the present application and features in the embodiments may be combined with each other at will if there is no conflict.

In the following description, many embodiments are described for a full understanding of the embodiments of the present application. However, the embodiments of the present application may also be implemented in other ways different from those described here. Therefore, the protection scope of the embodiments of the present application is not limited by the implementations disclosed below.

Figure 1:
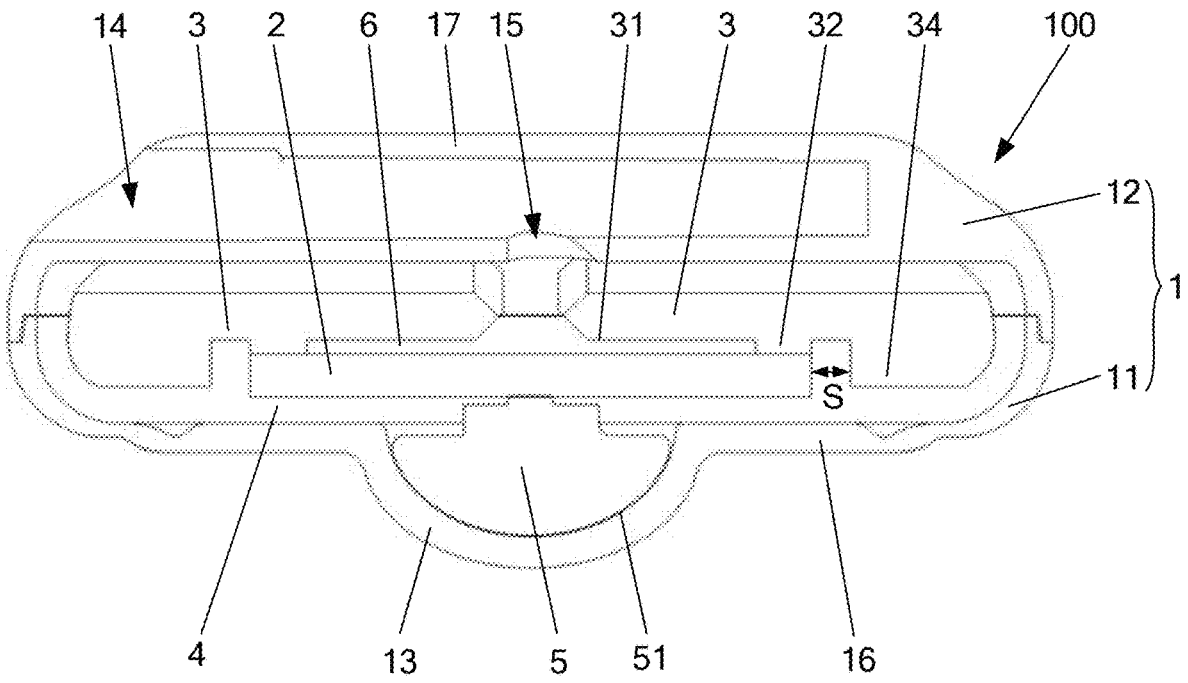
FIG. 1 is a schematic sectional view of a structure of a bone conduction hearing aid device according to an embodiment of the present application.
Figure 2:
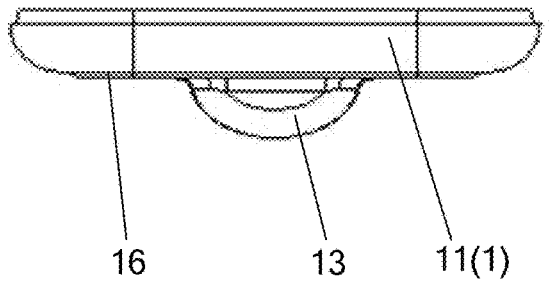
FIG. 2 is a schematic front view of a structure of a bottom housing of a bone conduction hearing aid device according to an embodiment of the present application.
Figure 3:
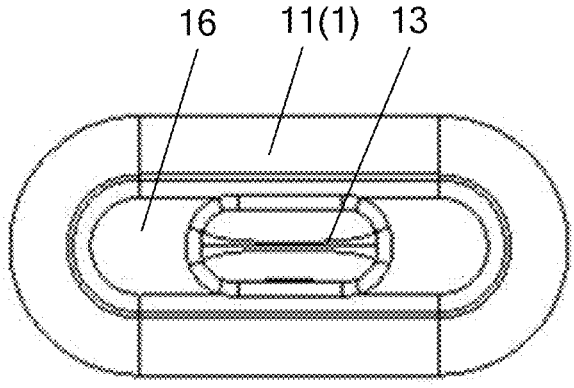
FIG. 3 is a schematic bottom view of a structure of a bottom housing of a bone conduction hearing aid device according to an embodiment of the present application.
Figure 4:
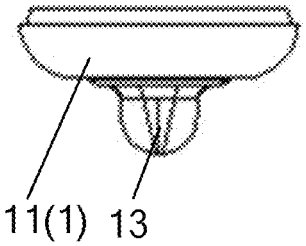
FIG. 4 is a schematic left view of a structure of a bottom housing of a bone conduction hearing aid device according to an embodiment of the present application.
Figure 5:
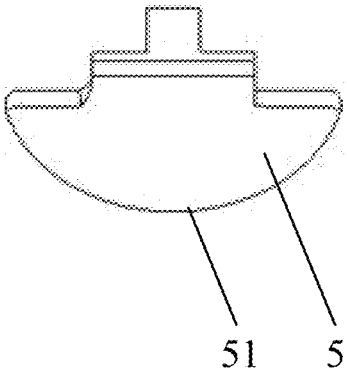
FIG. 5 is a schematic front view of a structure of a vibration transmission element of a bone conduction hearing aid device according to an embodiment of the present application.
Figure 6:
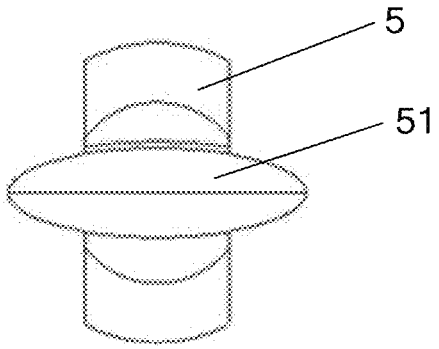
FIG. 6 is a schematic bottom view of a structure of a vibration transmission element of a bone conduction hearing aid device according to an embodiment of the present application.

As shown in FIG. 1, an embodiment of the present application provides a bone conduction hearing aid device 100, including: a housing 1, a piezoelectric vibration assembly and a vibration transmission element 5. The piezoelectric vibration assembly and the vibration transmission element 5 are both arranged in the housing 1. A first end of the vibration transmission element 5 is connected with the piezoelectric vibration assembly, and a second end of the vibration transmission element 5 is connected with the housing 1. The housing 1 includes a vibration output portion that outputs vibration through contact.

Figure 17:
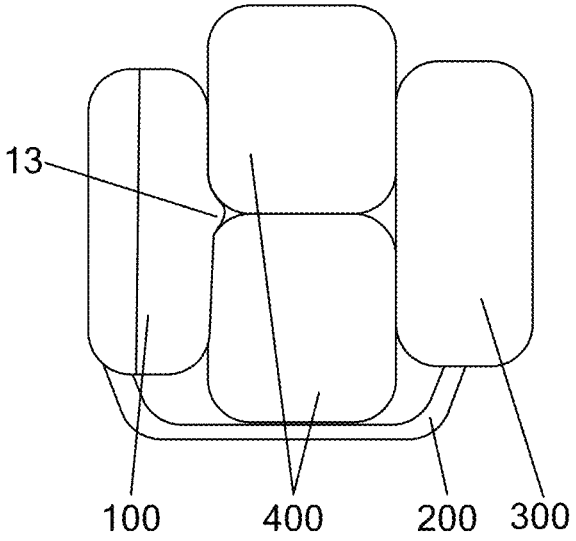
FIG. 17 is a schematic diagram of a structure of a bone conduction hearing aid device according to an embodiment of the present application when in a service state.

In some exemplary embodiments, as shown in FIG. 17, the vibration output portion is configured to be in contact with a tooth 400. The vibration output portion may be in contact with a dental crown of the tooth 400.

In the bone conduction hearing aid device 100, the piezoelectric vibration assembly may vibrate according to an electrical signal generated from sound, and the vibration is transmitted to the housing 1 through the vibration transmission element 5. The vibration output portion of the housing 1 can contact the tooth 400 (e.g., the dental crown) etc., and can transmit the vibration to the tooth 400, such that the vibration can be transmitted to a cochlea through a skull so as to achieve a purpose of hearing improvement.

The housing 1 of the bone conduction hearing aid device 100 transmits vibration through a non-invasive contact, such that the bone conduction hearing aid device 100 does not need to be anchored to the skull by surgery when it is installed, and the bone conduction hearing aid device 100 only needs to be brought into contact with the tooth 400. The installation is convenient, and use convenience of the bone conduction hearing aid device 100 is improved.

In other exemplary embodiments, the vibration output portion may be configured to be in contact with skin. The vibration from the vibration output portion can be transmitted to the bone through the skin, and then transmitted to the cochlea, so as to achieve the purpose of hearing improvement.

In some exemplary embodiments, the vibration output portion is configured to be in contact with one tooth 400 or two adjacent teeth 400.

As shown in FIG. 17, the vibration output portion is in contact with side wall surfaces of two adjacent teeth 400 (e.g., dental crowns), to enable the vibration to be transmitted to the two teeth 400, thereby the effectiveness and reliability of vibration transmission are increased and the effect of hearing aid is improved.

In some exemplary embodiments, the tooth 400 in contact with the vibration output portion may be a molar at an inner side of an oral cavity.

In some exemplary embodiments, as shown in FIGS. 1-4 and 17, the vibration output portion includes a protruding portion 13 which is arranged on a bottom wall 16 of the housing 1 and protrudes outwards. The protruding portion 13 is connected with the second end (the bottom end of the vibration transmission element 5, the lower end in FIG. 1) of the vibration transmission element 5, and an outer surface of the protruding portion 13 is configured to be in contact with the tooth 400 (e.g., the dental crown).

The two ends of the vibration transmission element 5 are respectively connected with the piezoelectric vibration assembly and the vibration output portion of the housing 1, so as to transmit the vibration from the piezoelectric vibration assembly directly to the vibration output portion, thereby the amplitude of the vibration output portion and the effectiveness of vibration output are increased, which is beneficial to improving the effect of hearing aid. The vibration output portion includes a protruding portion 13 which is arranged on the bottom wall 16 (at a side close to the tooth 400) of the housing 1 and protrudes outwards, and a close contact between the tooth 400 and the vibration output portion can be realized by the outer surface of the protruding portion 13, thereby reliability of the contact can be enhanced, which further increases the effectiveness of vibration transmission, so as to improve the effect of hearing aid.

The vibration transmission element 5 is similar to a knocker block, and knocks the tooth 400 by the protruding portion 13 of the housing 1 to vibrate the tooth 400, thus realizing transmission of vibration to the tooth 400.

In some exemplary embodiments, as shown in FIGS. 1-7 and 17, the protruding portion 13 is arc-shaped, and each of the inner surface and the outer surface of the protruding portion 13 is arc-shaped. The vibration transmission element 5 includes an arc-shaped mating surface 51 which is mated with the inner surface of the protruding portion 13, wherein the arc-shaped mating surface 51 is adhered and fixed to the inner surface of the protruding portion 13, and the outer surface of the protruding portion 13 is configured to be in contact with side wall surfaces of adjacent teeth.

The protruding portion 13 may protrude between two teeth 400. The arc-shaped outer surface of the protruding portion 13 can ensure an effective contact with side wall surfaces (e.g., side wall surfaces of dental crowns) of two adjacent teeth 400, such that the contact is closer and more reliable, and the vibration of the protruding portion 13 can be transmitted to the two teeth 400, thus increasing the effectiveness and reliability of vibration transmission and improving the effect of hearing aid.

As shown in FIG. 1, the protruding portion 13 may form an undulating structure at the bottom of the housing 1, which is beneficial to improving elasticity and vibration characteristics of the housing 1, so as to facilitate transmitting the vibration to the tooth 400 through the housing 1.

In some exemplary embodiments, as shown in FIGS. 1 and 5-7, the bottom of the vibration transmission element 5 has a semicircular shape, and a bottom surface of the semicircular shape is the arc-shaped mating surface 51 which is mated with the inner surface of the protruding portion 13.

In some exemplary embodiments, the vibration output portion includes a protruding portion 13 which is integrally formed on the bottom wall 16 of the housing 1. In other exemplary embodiments, the vibration output portion may be formed independently from other parts of the housing 1, and may be connected with other parts (such as the bottom wall 16 of the housing 1) of the housing 1 or with the vibration transmission element 5.

In some exemplary embodiments, as shown in FIG. 1, the piezoelectric vibration assembly includes a piezoelectric vibrator 2, two counterweights 3 and an elastic damping member 4. A middle portion of the piezoelectric vibrator 2 is fixedly connected with the first end of the vibration transmission element 5, the two counterweights 3 are respectively arranged on both sides of the piezoelectric vibrator 2, and the elastic damping member 4 is arranged between the piezoelectric vibrator 2 and the bottom wall 16 of the housing 1 and between the counterweights 3 and the bottom wall 16 of the housing 1.

The piezoelectric vibrator 2 has its middle portion fixed with the vibration transmission element 5, and both sides provided with the counterweights 3, thus forming a piezoelectric vibration assembly formed by a simple beam which has its middle portion fixed and both sides vibrating. When the piezoelectric vibrator 2 vibrates, the counterweights 3 can vibrate therewith and increase a vibration force transmitted by the vibration transmission element 5. With the arrangement of the elastic damping member 4, force output of the piezoelectric vibration assembly can ensure a gain while taking account of the frequency band, thus reaching a balance between the output gain and the bandwidth.

In some exemplary embodiments, as shown in FIGS. 1 and 8-10, each counterweight 3 includes a support surface 31, wherein a support portion 32 protruding towards the piezoelectric vibrator 2 is arranged on the support surface 31. The support portion 32 is supported on the piezoelectric vibrator 2, and an adhesive 6 is arranged between the support surface 31 of each counterweight 3 and the piezoelectric vibrator 2.

Each counterweight 3 is provided with a protruding support portion 32, wherein the support portion 32 is in contact with the piezoelectric vibrator 2. Thus, each counterweight 3 has a small contact area with the piezoelectric vibrator 2, and is prevented from affecting the vibration of the piezoelectric vibrator 2.

The adhesive 6 is provided between the support surface 31 of each counterweight 3 and the piezoelectric vibrator 2. The adhesive 6 does not affect the vibration of the piezoelectric vibrator 2, which is mainly because the joint surface between each counterweight 3 and the piezoelectric vibrator 2 has a small relative displacement during the vibration, and the adhesive 6 can also provide an elastic support between the counterweight 3 and the piezoelectric vibrator 2 to prevent the counterweight 3 from getting loose during the vibration.

In some exemplary embodiments, the adhesive 6 between the support surface 31 of each counterweight 3 and the piezoelectric vibrator 2 is M-11 adhesive produced by Loctite.

In some exemplary embodiments, as shown in FIG. 1, the projection of the gravity center of each counterweight 3 on the piezoelectric vibrator 2 falls on the contact surface between the support portion 32 of the counterweight 3 and the piezoelectric vibrator 2.

The projection of the gravity center of each counterweight 3 on the piezoelectric vibrator 2 falling on the contact surface between the support portion 32 of the counterweight 3 and the piezoelectric vibrator 2 enables the counterweight 3 to be stably installed, which can prevent the counterweight 3 from being skewed during vibration.

In some exemplary embodiments, as shown in FIG. 1, a portion of each counterweight 3 located at an outer side of the piezoelectric vibrator 2 is provided with a protrusion 34 which protrudes towards the bottom wall 16 of the housing 1, and a gap is formed between the protrusion 34 and the piezoelectric vibrator 2.

With the provision of the protrusions 34, space at both sides of the piezoelectric vibrator 2 in the housing 1 can be utilized for increasing the weight of the counterweights 3 and for increasing the vibration force transmitted by the vibration transmission element 5. A gap S is formed between each protrusion 34 and a side wall surface of the piezoelectric vibrator 2 close to the protrusion 34, so as to prevent the protrusion 34 from contacting the piezoelectric vibrator 2 and then affecting the vibration of the piezoelectric vibrator 2.

In some exemplary embodiments, each counterweight 3 is a tungsten steel block, and the tungsten steel block has a large density and a low cost.

In some exemplary embodiments, as shown in FIG. 1, the elastic damping member 4 includes silicone rubber which has a Shore-00 hardness of 45-65 and is filled at the bottom of the housing 1, wherein one end of the silicone rubber away from the bottom wall 16 of the housing 1 is flush with the support surface 31 of each counterweight 3.

One end (i.e., the top end) of the silicone rubber having a Shore-00 hardness of 45-65 away from the bottom wall 16 of the housing 1 is flush with the support surface 31 of each counterweight 3, i.e., flush with the adhesive 6, such that part of the counterweight 3 and the piezoelectric vibrator 2 are immersed in the silicone rubber.

In an exemplary embodiment, the Shore-00 hardness of the silicone rubber is 55.

In an exemplary embodiment, 4086 silicone rubber provided by Nusil may be used as the silicone rubber.

Figure 18:
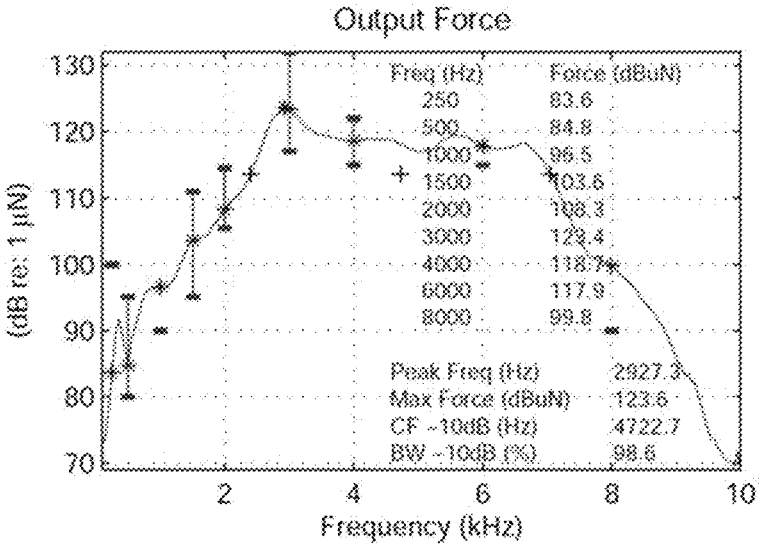
FIG. 18 is a schematic diagram of a frequency-output gain relationship of a bone conduction hearing aid device according to an embodiment of the present application.

Rubbers with different hardness have different output performance. As shown in FIG. 18, the hardness of silicone rubber is within a certain range (for example, the Shore-00 hardness is 45-65), and the elastic damping of the silicone rubber enables the output gain and bandwidth of the device to reach a balance, which can meet the use needs.

Figure 19:
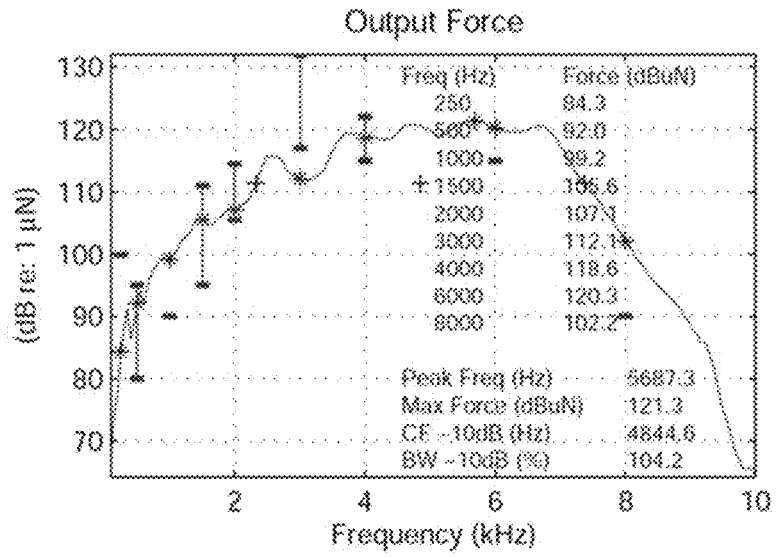
FIG. 19 is a schematic diagram of a frequency-output gain relationship of an elastic damping member of a bone conduction hearing aid device with an increased damping according to an embodiment of the present application.

As shown in FIG. 19, if the hardness of silicone rubber increases and the damping increases, the internal load consumption will be increased and the output gain will be decreased. An obvious change in the graph is that it is squashed (the output gain is decreased) and the bandwidth is widened. The output gain and the bandwidth are two negatively correlated parameters, and a trade-off between the output gain (the upper edge of the graph is high enough) and keeping the bandwidth (the upper edge is wide enough) is needed.

Figure 20:
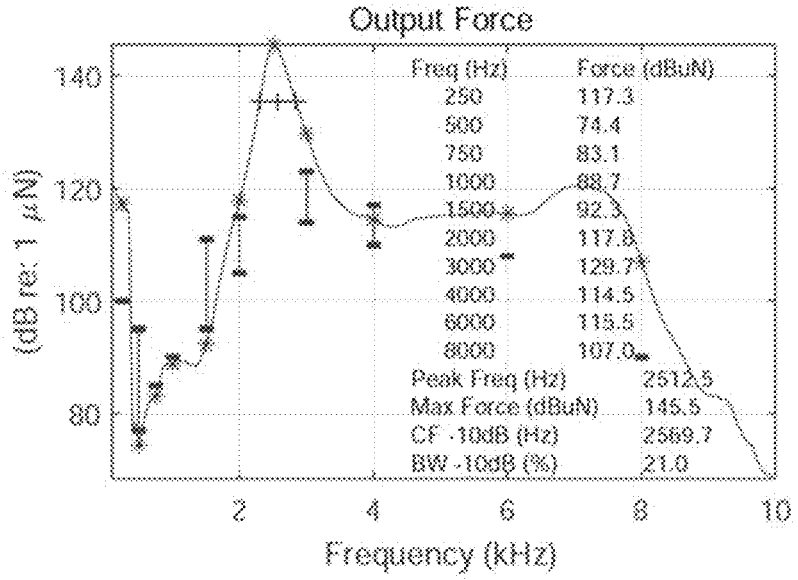
FIG. 20 is a schematic diagram of a frequency-output gain relationship of an elastic damping member of a bone conduction hearing aid device with a decreased damping according to an embodiment of the present application.

As shown in FIG. 20, if the hardness of silicone rubber decreases and the internal damping becomes smaller, an obvious resonance peak will appear. A resonance phenomenon will lead to unbalanced energy output in a spectrum range. In case of a device (e.g., an ultrasonic generator) that requires output at a single frequency point, a high resonance peak will be preferred. For a device that requires a wider frequency band, the output energy is expected to be flat and balanced over the entire frequency range.

In some exemplary embodiments, the piezoelectric vibrator 2 is made of a piezoelectric ceramic material.

Figure 7:
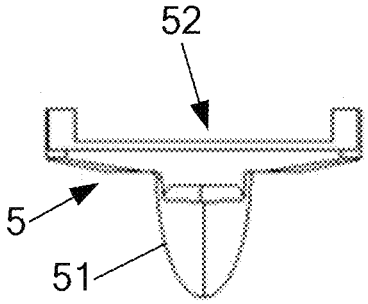
FIG. 7 is a schematic left view of a structure of a vibration transmission element of a bone conduction hearing aid device according to an embodiment of the present application.
Figure 8:
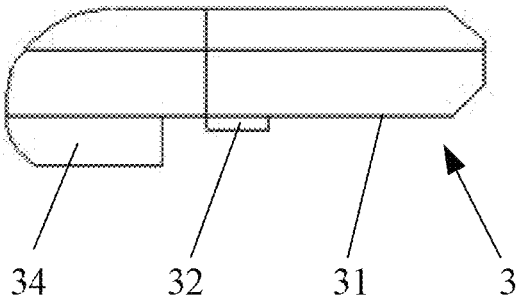
FIG. 8 is a schematic front view of a structure of a counterweight of a bone conduction hearing aid device according to an embodiment of the present application.
Figure 9:
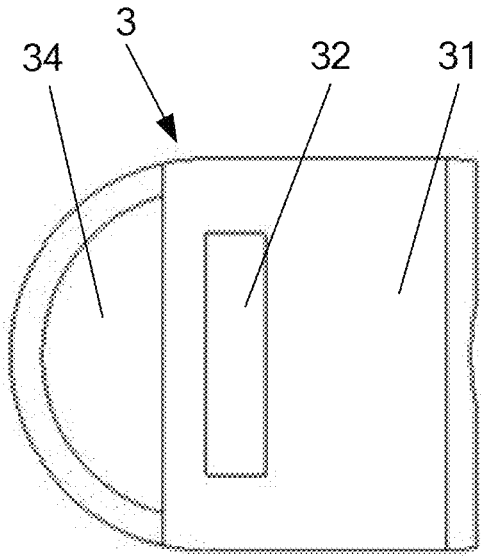
FIG. 9 is a schematic bottom view of a structure of a counterweight of a bone conduction hearing aid device according to an embodiment of the present application.

In some exemplary embodiments, as shown in FIG. 7, the first end of the vibration transmission element 5 is provided with an installation groove 52, and the middle portion of the piezoelectric vibrator 2 is fixed to the installation groove 52 by gluing.

In an exemplary embodiment, as shown in FIG. 7, the installation groove 52 is a grooved structure with an opening at the top end and both sides through, that is, the installation groove 52 has a bottom wall and two side walls, and the middle portion of the piezoelectric vibrator 2 may be installed in the installation groove 52 and glued and fixed to the installation groove 52 by an adhesive. The piezoelectric vibrator 2 is fixed to the bottom wall and both side walls of the installation groove 52, such that vibration is transmitted to the vibration transmission element 5 through the three wall surfaces, achieving good vibration transmission effect.

In some exemplary embodiments, a plastic housing is used as the housing 1. In an exemplary embodiment, the housing 1 may be made of HU1010 plastic produced by Sabic.

In some exemplary embodiments, the housing 1 is made by a metal hollow elastic piece. The hollow structure on the metal hollow elastic piece can improve the elasticity of the elastic piece.

In an exemplary embodiment, when the bone conduction hearing aid device 100 is installed in the oral cavity and is in contact with the tooth 400 to transmit vibration, a sealing film may be wrapped outside the metal hollow elastic piece to prevent saliva and the like from entering the bone conduction hearing aid device 100.

In some exemplary embodiments, the housing 1 has a wall thickness of 0.3 mm-0.5 mm. In an exemplary embodiment, the wall thickness of the housing 1 made of HU1010 plastic is 0.4 mm.

In some exemplary embodiments, as shown in FIGS. 1 and 14-16, a top wall 17 (a side away from the tooth 400) of the housing 1 is provided with a fixation groove 14. The fixation groove 14 is configured to fix a fixation member 200 of the bone conduction hearing aid device 100.

Figure 11:
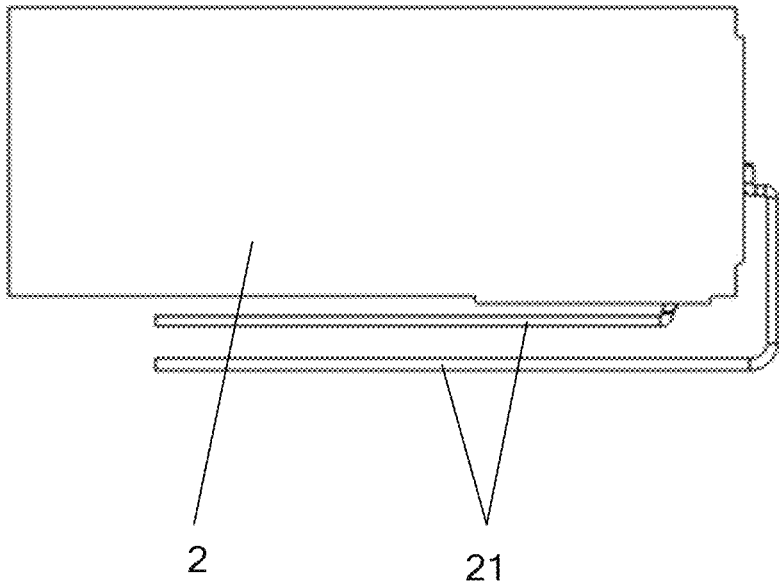
FIG. 11 is a schematic front view of a structure of a piezoelectric vibrator of a bone conduction hearing aid device according to an embodiment of the present application.
Figure 12:
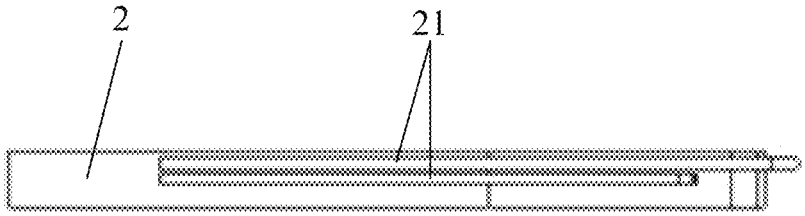
FIG. 12 is a schematic bottom view of a structure of a piezoelectric vibrator of a bone conduction hearing aid device according to an embodiment of the present application.
Figure 13:
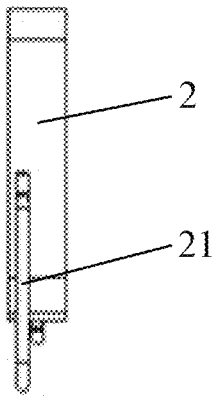
FIG. 13 is a schematic right view of a structure of a piezoelectric vibrator of a bone conduction hearing aid device according to an embodiment of the present application.
Figure 14:
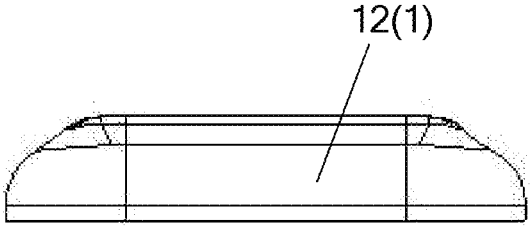
FIG. 14 is a schematic front view of a structure of a top cover of a bone conduction hearing aid device according to an embodiment of the present application.
Figure 15:
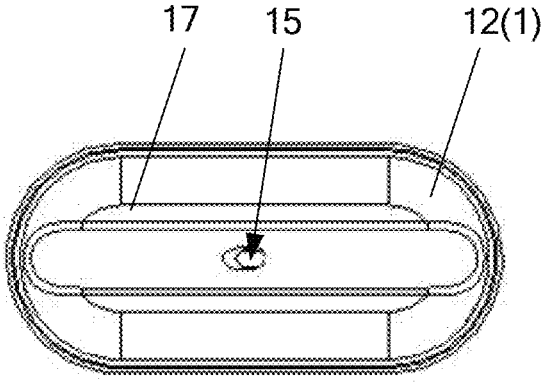
FIG. 15 is a schematic bottom view of a structure of a top cover of a bone conduction hearing aid device according to an embodiment of the present application.
Figure 16:
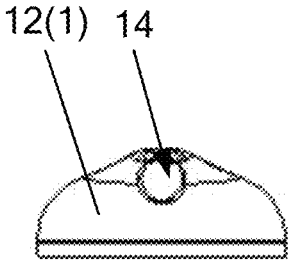
FIG. 16 is a schematic left view of a structure of a top cover of a bone conduction hearing aid device according to an embodiment of the present application.

In some exemplary embodiments, as shown in FIGS. 1 and 14-16, a groove wall of the fixation groove 14 is provided with a wire passing hole 15 communicating the fixation groove 14 with the inner cavity of the housing 1. A wire 21 (as shown in FIGS. 11-13) connected with the piezoelectric vibrator 2 may pass through the wire passing hole 15 and extend out of the housing 1, so as to be electrically connected with an electric control component 300.

In some exemplary embodiments, as shown in FIG. 17, the fixation member 200 is U-shaped and has a hollow structure. The fixation member 200 is configured to clamp the teeth 400. The wire 21 connected with the piezoelectric vibration assembly passes through the wire passing hole 15 and then extends into the fixation member 200, and is electrically connected with the electric control component 300 fixed at the other end of the fixation member 200.

In some exemplary embodiments, as shown in FIG. 17, the bone conduction hearing aid device 100 and the electric control component 300 are respectively arranged on two sides (i.e., the buccal side and the lingual side) of the teeth 400.

In some exemplary embodiments, the fixation member 200 is a U-shaped steel pipe having a good performance of corrosion resistance.

In an exemplary embodiment, as shown in FIG. 17, the bone conduction hearing aid device 100 may be arranged on the buccal side of the teeth (e.g., molars) 400, the electric control component 300 may be disposed on the lingual side of the teeth (e.g., molars) 400, and the two ends of the U-shaped fixation member 200 are respectively connected with the bone conduction hearing aid device 100 and the electric control component 300. The U-shaped fixation member 200 surrounds the rear side of the tooth (e.g., a molar) 400 and clamps the dental crowns of the teeth (e.g., molars) 400 from both sides, so as to realize fixation of the bone conduction hearing aid device 100 and the electric control component 300 through interference fit. The wire 21 connected with the piezoelectric vibrator 2 of the piezoelectric vibration assembly may extend into the fixation member 200 after passing through the wire passing hole 15, and is electrically connected with the electric control component 300 fixed at the other end of the fixation member 200.

Figure 10:
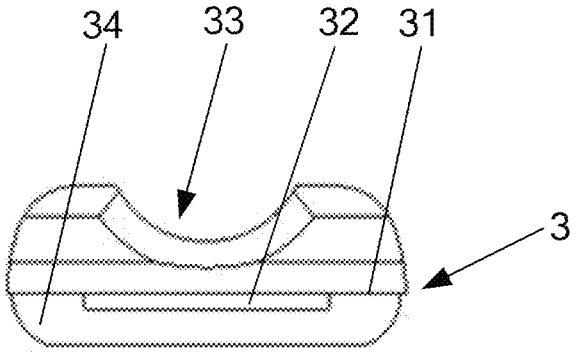
FIG. 10 is a schematic right view of a structure of a counterweight of a bone conduction hearing aid device according to an embodiment of the present application.

In some exemplary embodiments, as shown in FIG. 10, the top of each counterweight 3 is provided with an escape groove 33 in order to avoid the fixation groove 14 on the housing 1 in which the fixation member 200 is installed.

In some exemplary embodiments, as shown in FIGS. 1-4 and 14-16, the housing 1 includes a bottom housing 11 and a top cover 12. The bottom housing 11 and the top cover 12 are fixed by gluing, such that the housing 1 has a good sealing and waterproof performance. In the above, the vibration output portion (the protruding portion 13) may be provided on the bottom wall 16 of the bottom housing 11, and the fixation groove 14 may be provided on the top wall 17 of the top cover 12.

Any controlled vibration (bandwidth and amplitude) requires precise design of a damping elastic structure, so as to obtain an ideal force output with various essential factors balanced. In some cases, the main problem of a piezoelectric vibrator is that the vibration output bandwidth is in medium and high frequencies, and the output bandwidth is related to the size of the piezoelectric vibrator, if a frequency bandwidth needs to be wider, the size of the piezoelectric vibrator needs to be larger. If the piezoelectric vibrator is used in a small-sized part with limited space while a better bandwidth is expected to be obtained, it is necessary to design an appropriate damping elastic structure to reduce the peak value and expand the bandwidth, and shift the frequency band from high to low. In the embodiments of the present application, the thin-walled housing made of plastic, the undulating structure formed by the protruding portion at the bottom of the housing and the damping elastic structure formed by the filled elastic silicone rubber enable the bone conduction hearing aid device to have good vibration characteristics.

In the description of the embodiments of the present application, the term "top" indicating orientation or positional relations refers to a side away from the skin, bones or teeth in contact with the bone conduction hearing aid device, and the term "bottom" refers to a side close to the skin, bones or teeth in contact with the bone conduction hearing aid device.

Although the implementations disclosed in the embodiments of the present application are as described above, the described contents are only the implementations adopted for facilitating understanding of the embodiments of the present application, which are not intended to limit the embodiments of the present application. A person skilled in the art to which the embodiments of the present application pertain may make any modifications and variations in the form and details of implementation without departing from the spirit and scope of the embodiments of the present application. Nevertheless, the scope of patent protection of the embodiments of the present application shall still be determined by the scope defined by the appended claims.

What is claimed is:

1. A bone conduction hearing aid device, comprising: a housing, a piezoelectric vibration assembly and a vibration transmission element, wherein the piezoelectric vibration assembly and the vibration transmission element are both arranged in the housing, a first end of the vibration transmission element is connected with the piezoelectric vibration assembly, a second end of the vibration transmission element is connected with the housing, and the housing comprises a vibration output portion configured to output vibration through contact;

wherein the piezoelectric vibration assembly comprises a piezoelectric vibrator, two counterweights and an elastic damping member, a middle portion of the piezoelectric vibrator is fixedly connected with the first end of the vibration transmission element, the two counterweights are respectively arranged on both sides of the piezoelectric vibrator, and the elastic damping member is arranged between the piezoelectric vibrator and the bottom wall of the housing and between the counterweights and the bottom wall of the housing.

2. The bone conduction hearing aid device of claim 1, wherein the vibration output portion is configured to be in contact with a tooth.

3. The bone conduction hearing aid device of claim 2, wherein the vibration output portion is configured to be in contact with one tooth or two adjacent teeth.

4. The bone conduction hearing aid device of claim 2, wherein the vibration output portion comprises a protruding portion which is disposed on a bottom wall of the housing and protrudes outwards, the protruding portion is connected with the second end of the vibration transmission element, and an outer surface of the protruding portion is configured to be in contact with the tooth.

5. The bone conduction hearing aid device of claim 4, wherein the protruding portion is arc-shaped, an inner surface and the outer surface of the protruding portion are arc-shaped, the vibration transmission element comprises an arc-shaped mating surface which is mated with the inner surface of the protruding portion, the arc-shaped mating surface is adhered and fixed to the inner surface of the protruding portion, and the outer surface of the protruding portion is configured to be in contact with side wall surfaces of two adjacent teeth.

6. The bone conduction hearing aid device of claim 1, wherein each counterweight comprises a support surface and a support portion protruding towards the piezoelectric vibrator is arranged on the support surface, the support portion is supported on the piezoelectric vibrator, and an adhesive is provided between the support surface of the counterweight and the piezoelectric vibrator.

7. The bone conduction hearing aid device of claim 6, wherein a projection of the gravity center of each counterweight on the piezoelectric vibrator falls on a contact surface between the support portion of the counterweight and the piezoelectric vibrator.

8. The bone conduction hearing aid device of claim 6, wherein the elastic damping member comprises silicone rubber which has a Shore-00 hardness of 45-65 and is filled at the bottom of the housing, and one end of the silicone rubber away from the bottom wall of the housing is flush with the support surfaces of the counterweights.

9. The bone conduction hearing aid device of claim 1, wherein the first end of the vibration transmission element is provided with an installation groove, and the middle portion of the piezoelectric vibrator is fixed to the installation groove by gluing.

10. The bone conduction hearing aid device of claim 1, wherein the housing is a plastic housing, or is made by a metal hollow elastic piece.

11. The bone conduction hearing aid device of claim 1, wherein a wall thickness of the housing is 0.3 mm-0.5 mm.

12. The bone conduction hearing aid device of claim 1, wherein a top wall of the housing is provided with a fixation groove and the fixation groove is configured to fix a fixation member of the bone conduction hearing aid device.

13. The bone conduction hearing aid device of claim 12, wherein a groove wall of the fixation groove is provided with a wire passing hole configured to communicate the fixation groove with an inner cavity of the housing.

14. The bone conduction hearing aid device of claim 13, wherein the fixation member is U-shaped and has a hollow structure, the fixation member is configured to clamp the tooth, a wire connected with the piezoelectric vibration assembly passes through the wire passing hole and then extends into the fixation member, and the wire is electrically connected with an electric control component fixed at the other end of the fixation member.

15. The bone conduction hearing aid device of claim 2, wherein the housing is a plastic housing, or is made by a metal hollow elastic piece.

* * * * *